US011238792B2

(12) United States Patent
Liu et al.

(10) Patent No.: US 11,238,792 B2
(45) Date of Patent: Feb. 1, 2022

(54) PIXEL CIRCUIT AND DISPLAY DEVICE

(71) Applicant: SeeYa Optronics Co., Ltd., Shanghai (CN)

(72) Inventors: Ping-Lin Liu, Shanghai (CN); Haodong Zhang, Shanghai (CN); Dong Qian, Shanghai (CN)

(73) Assignee: SeeYA Optronics Co., Ltd., Shanghai (CN)

( * ) Notice: Subject to any disclaimer, the term of this patent is extended or adjusted under 35 U.S.C. 154(b) by 0 days.

(21) Appl. No.: 16/627,010

(22) PCT Filed: Jul. 10, 2018

(86) PCT No.: PCT/CN2018/095118
§ 371 (c)(1),
(2) Date: Dec. 27, 2019

(87) PCT Pub. No.: WO2020/010512
PCT Pub. Date: Jan. 16, 2020

(65) Prior Publication Data

US 2021/0287603 A1 Sep. 16, 2021

Related U.S. Application Data

(63) Continuation-in-part of application No. PCT/CN2018/095118, filed on Jul. 10, 2018.

(51) Int. Cl.
*G09G 3/3233* (2016.01)
*G09G 3/3258* (2016.01)
*G09G 3/3291* (2016.01)

(52) U.S. Cl.
CPC ..... *G09G 3/3233* (2013.01); *G09G 3/3258* (2013.01); *G09G 3/3291* (2013.01)

(58) Field of Classification Search
CPC .. G09G 3/3233; G09G 3/3258; G09G 3/3283; G09G 3/3291; G09G 2300/0819; G09G 2320/043; G09G 2320/0233
(Continued)

(56) References Cited

U.S. PATENT DOCUMENTS 8,212,749 B2 7/2012 Cho et al.
8,319,707 B2 * 11/2012 Kwon ..... G09G 3/3233 345/76
(Continued)

FOREIGN PATENT DOCUMENTS

CN 101364379 A 2/2009
CN 103151016 A 6/2013
(Continued)

OTHER PUBLICATIONS

Int'l Search Report for PCT/CN2018/095118, dated Mar. 28, 2019.
Office Action issued in corresponding Chinese Patent Appln. No. 201810751529.5, dated Jul. 30, 2020.

*Primary Examiner* — Tom V Sheng
(74) *Attorney, Agent, or Firm* — W&G Law Group

(57) ABSTRACT

The present disclosure relates to a pixel circuit and a display device. The pixel circuit includes: a pixel unit including: an operation current generating module including a gate voltage terminal and a drain voltage terminal and adapted to generate an operation current based on a voltage at the gate voltage terminal; and a light-emitting control module connected in series with the operation current generating module and adapted to control whether or not to provide the operation current to a light-emitting device based on a light-emitting control signal; and a driving control circuit, including: a feedback module for receiving a first input voltage and a data current and adapted to provide a feedback loop between the gate voltage terminal and the drain voltage
(Continued)

terminal; and a data current module adapted to provide the data current.

14 Claims, 5 Drawing Sheets

(58) Field of Classification Search
USPC ..... 345/204
See application file for complete search history.

(56) References Cited

U.S. PATENT DOCUMENTS

| | | | | |
|---|---|---|---|---|
| 8,553,018 | B2 * | 10/2013 | Nathan | G09G 3/3266 345/204 |
| 8,937,615 | B2 * | 1/2015 | Kim | G09G 3/3233 345/211 |
| 9,330,625 | B2 | 5/2016 | Xu et al. | |
| 9,626,906 | B2 | 4/2017 | Kim et al. | |
| 9,940,878 | B2 | 4/2018 | Liang | |
| 10,078,984 | B2 * | 9/2018 | Nathan | H05B 45/00 |
| 10,147,353 | B2 | 12/2018 | Xiang et al. | |
| 10,825,386 | B2 | 11/2020 | Yan | |
| 2003/0020413 | A1 * | 1/2003 | Oomura | G09G 3/3241 315/169.3 |
| 2007/0115225 | A1 * | 5/2007 | Uchino | G09G 3/3233 345/76 |
| 2007/0200804 | A1 * | 8/2007 | Kwon | G09G 3/3291 345/76 |
| 2009/0040212 | A1 | 2/2009 | Wang | |
| 2009/0121974 | A1 * | 5/2009 | Yamashita | G09G 3/3233 345/55 |
| 2009/0244051 | A1 | 10/2009 | Hayafuji et al. | |
| 2010/0103159 | A1 | 4/2010 | Leon | |
| 2012/0025737 | A1 * | 2/2012 | Kikuchi | H03F 3/087 315/307 |
| 2013/0300724 | A1 * | 11/2013 | Chaji | G09G 3/3283 345/212 |
| 2016/0307503 | A1 * | 10/2016 | Song | G09G 3/3291 |
| 2017/0053590 | A1 | 2/2017 | Song et al. | |
| 2017/0103688 | A1 | 4/2017 | Bi et al. | |
| 2017/0206839 | A1 | 7/2017 | Wu et al. | |
| 2018/0190192 | A1 * | 7/2018 | Kwon | G09G 3/3266 |

FOREIGN PATENT DOCUMENTS

| | | | |
|---|---|---|---|
| CN | 104700761 | A | 6/2015 |
| CN | 104732918 | A | 6/2015 |
| CN | 105047137 | A | 11/2015 |
| CN | 106409225 | A | 2/2017 |
| CN | 106504706 | A | 3/2017 |
| CN | 107680531 | A | 2/2018 |
| KR | 20070054862 | A | 5/2007 |

* cited by examiner

PIXEL CIRCUIT AND DISPLAY DEVICE

RELATED APPLICATION DATA

This application is a 371 continuation of International Patent Application No. PCT/CN2018/095118, filed on Jul. 10, 2018, the contents of which are hereby incorporated by reference.

TECHNICAL FIELD

The present disclosure relates to the field of display panel technologies, and in particular, to a pixel circuit and a display device.

BACKGROUND

An organic electroluminescent device (OLED) is an all-solid device that directly converts electrical energy into light energy, and has attracted much attention in the industry and is considered as a new generation of display device due to its advantages such as thinness, lightness, high contrast, fast response, a wide viewing angle, a wide operation temperature range and the like. To practically achieve its large-scale industrialization, it is necessary to improve light-emitting efficiency and stability of the device and design an effective pixel circuit.

The existing pixel circuits are generally classified into a voltage-type pixel circuit and a current-type pixel circuit. The current-type pixel circuit can effectively compensate a threshold voltage drift and channel mobility of a driving transistor. However, the current-type pixel circuit has a problem that it would take quite long time to establish a gate voltage of the driving transistor, resulting in that the gate voltage of the driving transistor cannot quickly follow a data current signal in microsecond scanning time for one row of pixels. This would affect establishment of an operation current of the light-emitting device in the pixel circuit.

SUMMARY

The technical problem solved by the present disclosure is how to quickly establish a voltage for generating an operation current of a light-emitting device in a current-type pixel circuit.

In order to solve the technical problem described above, an embodiment of the present disclosure provides a pixel circuit. The pixel circuit includes: a pixel unit including: an operation current generating module including a gate voltage terminal and a drain voltage terminal and adapted to generate an operation current based on a voltage at the gate voltage terminal; and a light-emitting control module connected in series with the operation current generating module and adapted to control whether or not to provide the operation current to a light-emitting device based on a light-emitting control signal; and a driving control circuit, including: a feedback module for receiving a first input voltage and a data current and adapted to provide a feedback loop between the gate voltage terminal and the drain voltage terminal; and a data current module adapted to provide the data current.

Optionally, the data current module is connected to a data voltage terminal, and the data current module is adapted to generate the data current according to a voltage at the data voltage terminal, or receive the data current from outside and provide the data current to the feedback module.

Optionally, the data current module includes an operational amplifier and a resistor, the operational amplifier includes a first input terminal connected to the data voltage terminal, a second input terminal, and an output terminal connected to the second input terminal of the operational amplifier, and the resistor includes a firs terminal connected to the output terminal of the operational amplifier, and a second terminal connected to the drain voltage terminal.

Optionally, the pixel circuit further includes a brightness adjustment module. The brightness adjustment module is adapted to compare a voltage at the drain voltage terminal with a preset voltage and output a compensation control signal, and the compensation control signal controls the data voltage terminal to receive different data voltages.

Optionally, the brightness adjustment module includes: a comparator including: a first input terminal for receiving the preset voltage, a second input terminal connected to the drain voltage terminal, and an output terminal for outputting the compensation control signal; and a gating switch including a first input terminal for receiving a first data voltage, a second input terminal for receiving a second data voltage, an output terminal connected to the data voltage terminal, and a control terminal for receiving the compensation control signal.

Optionally, the operation current generating module includes: a driving module including a control terminal connected to the gate voltage terminal through a first gating module and adapted to generate the operation current based on a voltage at the control terminal of the driving module, the first gating module being turned on or turned off under control of a first gating control signal; a second gating module, through which an output terminal of the driving module is connected to the drain voltage terminal, the second gating module being turned on or turned off under control of a second gating control signal; and a voltage maintaining module configured to maintain the voltage at the control terminal of the driving module when the first gating module is turned off.

Optionally, the driving module includes a first transistor. The first transistor includes a source electrode connected to a power supply, a gate electrode being the control terminal of the driving module, and a drain electrode being the output terminal of the driving module.

Optionally, the first gating module includes a second transistor, and the second transistor includes a gate electrode for receiving the first gating control signal, a source electrode connected to the control terminal of the driving module, and a drain electrode connected to the gate voltage terminal.

Optionally, the second gating module includes a third transistor, and the third transistor includes a gate electrode for receiving the second gating control signal, a drain electrode connected to the drain voltage terminal, and a source electrode connected to the output terminal of the driving module.

Optionally, the voltage maintaining module includes a capacitor, and the capacitor includes a first electrode plate connected to the control terminal of the driving module, and a second electrode plate connected to a reference voltage terminal.

Optionally, the pixel circuit further includes a brightness adjustment module. The brightness adjustment module is adapted to compare a voltage at the drain voltage terminal with a preset voltage and output a compensation control signal, and the compensation control signal controls the reference voltage terminal to receive different reference voltages.

Optionally, the brightness adjustment module includes: a comparator including: a first input terminal for receiving the preset voltage, a second input terminal connected to the drain voltage terminal, and an output terminal for outputting the compensation control signal; and a gating switch including a first input terminal for receiving a first reference voltage, a second input terminal for receiving a second reference voltage, an output terminal connected to the reference voltage terminal, and a control terminal for receiving the compensation control signal.

Optionally, the light-emitting control module includes a fourth transistor, and the fourth transistor includes a gate electrode for receiving the light-emitting control signal, a drain electrode connected to an output terminal of the operation current generating module, and a source electrode connected to the light-emitting device.

Optionally, the feedback module includes a voltage buffer, and the voltage buffer includes a first input terminal connected to the drain voltage terminal and to an output terminal of the data current module, a second input terminal for receiving the first input voltage, and an output terminal connected to the gate voltage terminal.

Optionally, the pixel circuit further includes a fifth transistor, and the fifth transistor includes a gate electrode for receiving a reset control signal, a source electrode for receiving a reset voltage, and a drain electrode connected to the drain voltage terminal.

In order to solve the technical problem described above, an embodiment of the present disclosure further provides a display device including the pixel circuit described above.

Compared with the prior art, the technical solution in the embodiments of the present disclosure has following beneficial effects.

The pixel circuit in the technical solution of the present disclosure includes the pixel unit, and the pixel unit includes: an operation current generating module including a gate voltage terminal and a drain voltage terminal and adapted to generate an operation current according to a voltage at the gate voltage terminal; and a light-emitting control module connected in series with the operation current generating module and adapted to control whether or not to provide the operation current to a light-emitting device according to a light-emitting control signal; and a driving control circuit, including: a feedback module for receiving a first input voltage and a data current and adapted to provide a feedback loop between the gate voltage terminal and the drain voltage terminal; and a data current module adapted to provide the data current. Therefore, the voltage at the gate voltage terminal can be quickly established through the feedback loop without paying a large direct current cost.

Further, the pixel circuit in the technical solution of the present disclosure further includes the brightness adjustment module, and the brightness adjustment module is adapted to compare a voltage at the drain voltage terminal with a preset voltage and output a compensation control signal, and the compensation control signal controls the data voltage terminal to receive different data voltages or controls the reference voltage terminal to receive different reference voltages. Therefore, the operation current can be compensated in time to avoid or ameliorate a problem of dark brightness caused by aging of the light-emitting device.

Further, the pixel circuit in the technical solution of the present disclosure further includes the fifth transistor, and the fifth transistor includes: a gate electrode for receiving a reset control signal, a source electrode for receiving a reset voltage, and a drain electrode connected to the drain voltage terminal. Therefore, the related device in the pixel circuit can be reset after a previous frame of signal ends displaying, thereby effectively reducing an influence of the previous frame of signal on a next frame signal.

Further, the pixel circuit in the technical solution of the present disclosure further includes the data current module. The data current module includes an operational amplifier and a resistor; the operational amplifier includes: a first input terminal connected to the data voltage terminal, a second input terminal, and an output terminal connected to the second input terminal of the operational amplifier; the resistor includes: a firs terminal connected to the output terminal of the operational amplifier, and a second terminal connected to the drain voltage terminal. Therefore, the data voltage is received by the operational amplifier, and an influence of the data voltage jitter is reduced by the negative feedback loop of the operational amplifier, so that the outputted data current can be more stable.

DESCRIPTION OF EMBODIMENTS

In order to make the above-described purpose, features, and advantages of the present disclosure more illustrative, the prior art and embodiments in the present disclosure will be described in details in the following with reference to the accompanying drawings. It should be noted that the embodiments described herein are merely some instead of all embodiments of the present disclosure. All other embodiments obtained by a person skilled in the art based on the embodiments of the present disclosure without creative efforts are within the scope of the present disclosure.

Figure 1:
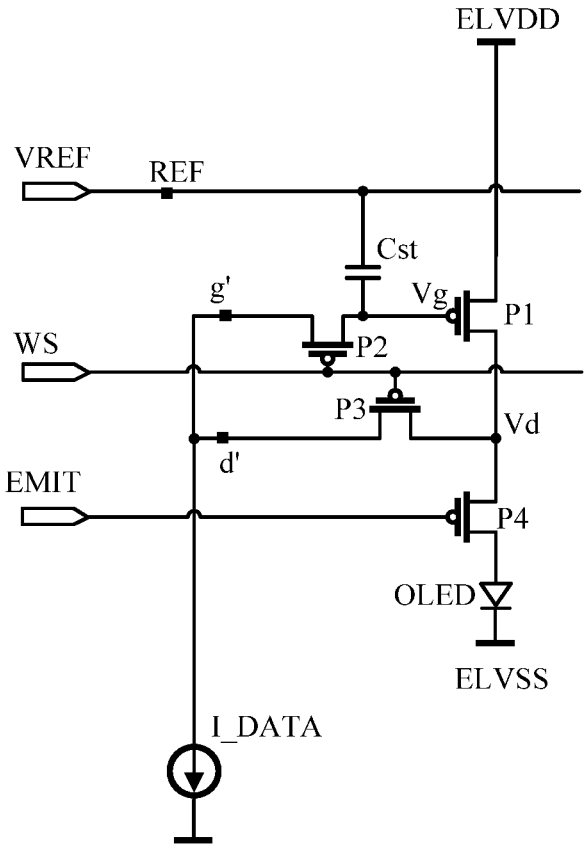
FIG. 1 (Prior Art)
FIG. 1 is a schematic diagram of a structure of a pixel circuit in the related art.
Figure 2:
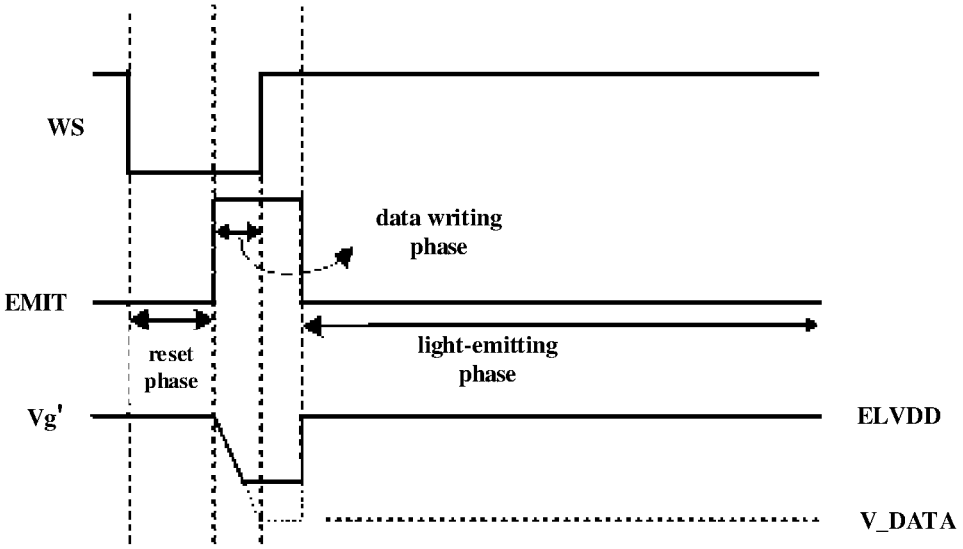
FIG. 2 (Prior Art)
FIG. 2 is a sequence diagram of an operation of a pixel circuit in the related art.

FIG. 1 is a schematic diagram of a structure of a pixel circuit in the related art, and FIG. 2 is a sequence diagram of an operation of a pixel circuit in the related art.

With reference to FIG. 1 and FIG. 2, the pixel circuit in the related art includes a first transistor P1, a second transistor P2, a third transistor P3, a fourth transistor P4, a capacitor Cst, and a light-emitting device OLED. The first transistor P1 includes a source electrode connected to a power supply ELVDD, and a drain electrode connected to a drain electrode of the fourth transistor P4. The light-emitting device OLED includes an anode connected to a source electrode of the fourth transistor P4, and a cathode connected to Ground ELVSS. The capacitor Cst includes a first electrode plate connected to a gate electrode of the first transistor P1, and a second electrode plate connected to a reference voltage terminal REF.

During a reset phase, the anode of the light-emitting device OLED and the gate electrode of the first transistor P1 receive a reset voltage (not shown) to complete resetting of the light-emitting device OLED and the first transistor P1, so as to eliminate an influence of a previous frame of signal on a next frame of signal.

During a data writing phase, a gating control signal WS is set to be at a low level, and a light-emitting control signal EMIT is set to be at a high level. A gate voltage terminal g' receives a data current I_DATA. The gate electrode of the first transistor P1 is connected to the gate voltage terminal g' through the second transistor P2. At this time, since the second transistor P2 and the third transistor P3 are turned on and the fourth transistor P4 is turned off, a voltage Vg at the gate electrode of the first transistor P1 is equal to a voltage Vg' at the gate voltage terminal g', a voltage Vd' at a drain voltage terminal d' is equal to a voltage Vd at the drain electrode of the first transistor P1 and the gate voltage terminal g' is connected to the drain voltage terminal d', then a connection manner of the first transistor P1 is equivalent to a connection manner of a diode. If there is sufficient time, the current I_DATA will pull down the voltage Vg' at the gate voltage terminal g' to a voltage corresponding to the data current I_DATA, that is, the voltage Vg at the gate electrode of the first transistor P1 is also pulled down to the voltage corresponding to the data current I_DATA.

Subsequently, the gating control signal WS is set to be at a low level, the second transistor P2 is turned off, and the voltage Vg at the gate electrode of the first transistor P1 is maintained by the capacitor Cst.

During a light-emitting phase, the gating control signal WS is set to be at a high level and the light-emitting control signal EMIT is set to be at a low level, and then the second transistor P2 and the third transistor P3 are turned off and the fourth transistor P4 is turned on. At this time, an operation current corresponding to the voltage Vg at the gate electrode of the first transistor P1 maintained by the capacitor Cst flows to the light-emitting device OLED, and the light-emitting device OLED emits light.

During the data writing phase, since one row of pixels only corresponds to microsecond scanning time, that is, a turned-on duration of the second transistor P2 and the third transistor P3 includes only a few microseconds each time the data is being written. During operation time of the few microseconds, the data current I_DATA cannot completely pull down the voltage Vg' at the gate voltage terminal g' to the voltage corresponding to the data current I_DATA, and also cannot pull down the voltage Vg at the gate electrode of the first transistor P1 to the voltage corresponding to the data current I_DATA. As a result, in a subsequent light-emitting phase, brightness of the light-emitting device OLED is not brightness corresponding to the data current I_DATA.

In the technical solution of the present disclosure, a feedback module is provided in the pixel circuit, and the feedback module is adapted to provide a feedback loop between the gate voltage terminal and the drain voltage terminal. In this case, the voltage at the gate voltage terminal can be pulled down to the voltage value corresponding to the data current through the feedback loop without paying a cost of a large DC current, and the voltage at the gate voltage terminal and the voltage of the light-emitting device can be quickly and separately established.

Figure 3:
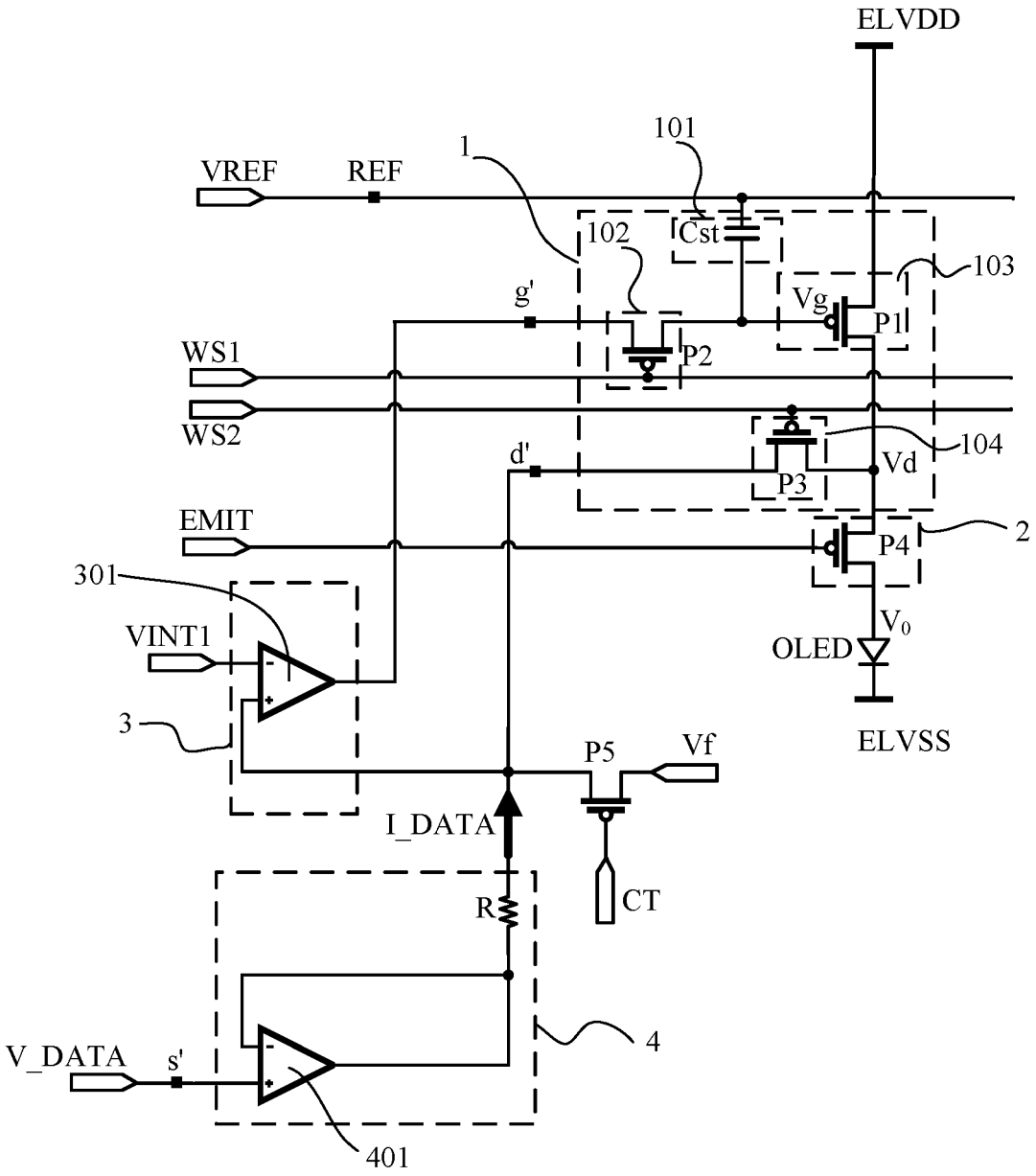
FIG. 3 is a schematic diagram of a structure of a pixel circuit according to an embodiment of the present disclosure.

FIG. 3 is a schematic diagram of a structure of a pixel circuit according to an embodiment of the present disclosure.

With reference to FIG. 3, the pixel circuit may include a pixel unit, and the pixel unit may include: an operation current generating module 1 including a gate voltage terminal g' and a drain voltage terminal d', and adapted to generate an operation current according to a voltage Vg' at the gate voltage terminal g'; and a light-emitting control module 2 connected in series with the operation current generating module 1 and adapted to control whether or not the operation current is supplied to the light-emitting device OLED according to the light-emitting control signal EMIT.

The pixel circuit may further include a driving control circuit, and the driving control circuit may include: a feedback module 3 receiving a first input voltage VINT1 and a data current I_DATA and adapted to provide a feedback loop between the gate voltage terminal g' and the drain voltage terminal d'; and a data current module 4 adapted to provide the data current I_DATA.

Further, the gate voltage terminal g' and the drain voltage terminal d' may be connection ports for signal interactions between the pixel unit and other components in the entire pixel circuit.

In a non-limiting example, the data current module 4 can receive the data current I_DATA from outside and provide it to the feedback module 3. The data current module 4 can filter the data current I_DATA directly provided from outside, so as to reduce a current ripple in the data current I_DATA.

In another non-limiting example, the data current module 4 may be connected to a data voltage terminal s', and the data current module 4 can generate the data current I_DATA based on a voltage at the data voltage terminal s'. Hereinafter, the present disclosure will be described in details by taking an example in which the data current module 4 generates the data current I_DATA based on the voltage at the data voltage terminal s'.

Further, the data current module 4 may include an operational amplifier 401 and a resistor R. A first input terminal of the operational amplifier 401 is connected to the data voltage terminal s' and receives the data voltage V_DATA through the data voltage terminal s', and a second input terminal of the operational amplifier 401 is connected to an output terminal of the operational amplifier 401. The resistor R includes a first terminal connected to the output terminal of the operational amplifier 401, and a second terminal connected to the drain voltage terminal d'.

Specifically, the first input terminal of the operational amplifier 401 may be a positive input terminal, and the second input terminal of the operational amplifier 401 may be a negative input terminal. The resistor R may be a constant resistor or a variable resistor, and a resistance value of the resistor R can be set according to a specific application case.

Specifically, the light-emitting control signal EMIT may be a level signal. For example, when the light-emitting control signal EMIT is at a low level, the light-emitting control module 2 can be controlled to be turned on; and when the light-emitting control signal EMIT is at a high level, the light-emitting control module 2 can be controlled to be turned off.

Specifically, the light-emitting device OLED may be a light-emitting diode. The light-emitting diode includes an anode connected to the light-emitting control module 2, and a cathode connected to Ground ELVSS.

More specifically, the light-emitting diode may be an organic light-emitting diode.

It should be noted that the pixel circuit in the embodiments of the present disclosure can be used to supply power to various light-emitting devices. The embodiments of the present disclosure do not limit a type of the light-emitting device OLED.

Further, the operation current generating module 1 may include: a driving module 103 including a control terminal connected to the gate voltage terminal g' though a first gating module 102 and adapted to generate an operation current according to a voltage at the control terminal, the first gating module 102 being turned on or off under control of the first gating control signal WS1; a second gating module 104, through which the output terminal of the driving module 103 is connected to the drain voltage terminal d', and which is turned on or off under control of the second gating control signal WS2; and a voltage maintaining module 101 configured to maintain the voltage at the control terminal of the driving module 103 when the first gating module 102 is turned off.

Further, the driving module 103 may include a first transistor P1. The first transistor P1 includes a source electrode that may be connected to the power supply ELVDD, and a gate electrode that may serve as a control terminal of the driving module 103, and a drain electrode that may serve as an output terminal of the driving module 103.

Further, the first gating module 102 may include a second transistor P2. The second transistor P2 includes a gate electrode for receiving the first gating control signal WS1, a source electrode connected to the control terminal of the driving module 103, and a drain electrode connected to the gate voltage terminal g'. The second gating module 104 may include a third transistor P3. The third transistor P3 includes a gate electrode that may receive the second gating control signal WS2, a drain electrode connected to the drain voltage terminal d', and a source electrode connected to the output terminal of the driving module 103.

Specifically, the first gating control signal WS1 and the second gating control signal WS2 may be level signals. For example, when the first gating control signal WS1 and/or the second gating control signal WS2 are at a low level, the second transistor P2 and/or the third transistor P3 can be controlled to be turned on; and when the first gating control signal WS1 and/or the second gating control signal WS2 are at a high level, the second transistor P2 and/or the third transistor P3 can be controlled to be turned off.

Further, the voltage maintaining module 101 may include a capacitor Cst. The capacitor Cst includes a first electrode plate connected to the control terminal of the driving module 103, and a second electrode plate connected to the reference voltage terminal REF. The capacitor Cst is configured to maintain the voltage at the control terminal of the driving module 103 after a voltage at the control terminal of the driving module 103 is established.

Further, a reference voltage VREF received by the reference voltage terminal REF may be a direct current (DC) voltage or an alternating current (AC) voltage.

Further, the light-emitting control module 2 may include a fourth transistor P4. The fourth transistor P4 includes a gate electrode for receiving the light-emitting control signal EMIT, a drain electrode connected to the output terminal of the operation current generating module 1, and a source electrode connected to the light-emitting device OLED. Specifically, the output terminal of the operation current generating module 1 is a port for outputting the operation current.

Specifically, the light-emitting control signal EMIT may be a level signal. For example, when the light-emitting control signal EMIT is at a low level, the fourth transistor P4 can be controlled to be turned on; and when the light-emitting control signal EMIT is at a high level, the fourth transistor P4 can be controlled to be turned off.

Further, the feedback module 3 may include a voltage buffer 301. The voltage buffer 301 includes a first input terminal connected to the drain voltage terminal d' and to an output terminal of a data current module 4, a second input terminal for receiving a first input voltage VINT1, and an output terminal connected to the gate voltage terminal g'.

Further, the voltage buffer 301 may be a first operational amplifier. Correspondingly, the first input terminal of the voltage buffer 301 may be a positive input terminal of the first operational amplifier, and the second input terminal of the voltage buffer 301 may be a negative input terminal of the first operational amplifier.

Further, the pixel circuit may further include a fifth transistor P5. The fifth transistor P5 includes a gate electrode for receiving a reset control signal CT, a source electrode for receiving a reset voltage Vf, and a drain electrode connected to the drain voltage terminal d'.

Specifically, the reset control signal CT may be a level signal. For example, when the reset control signal CT is at a low level, the fifth transistor P5 can be controlled to be turned on; and when the reset control signal CT is at a high level, the fifth transistor P5 can be controlled to be turned off.

Further, the reset voltage Vf may be smaller than a turn-on voltage of the light-emitting device OLED, thereby ensuring that the light-emitting device OLED is not accidentally turned on during the reset phase.

Figure 4:
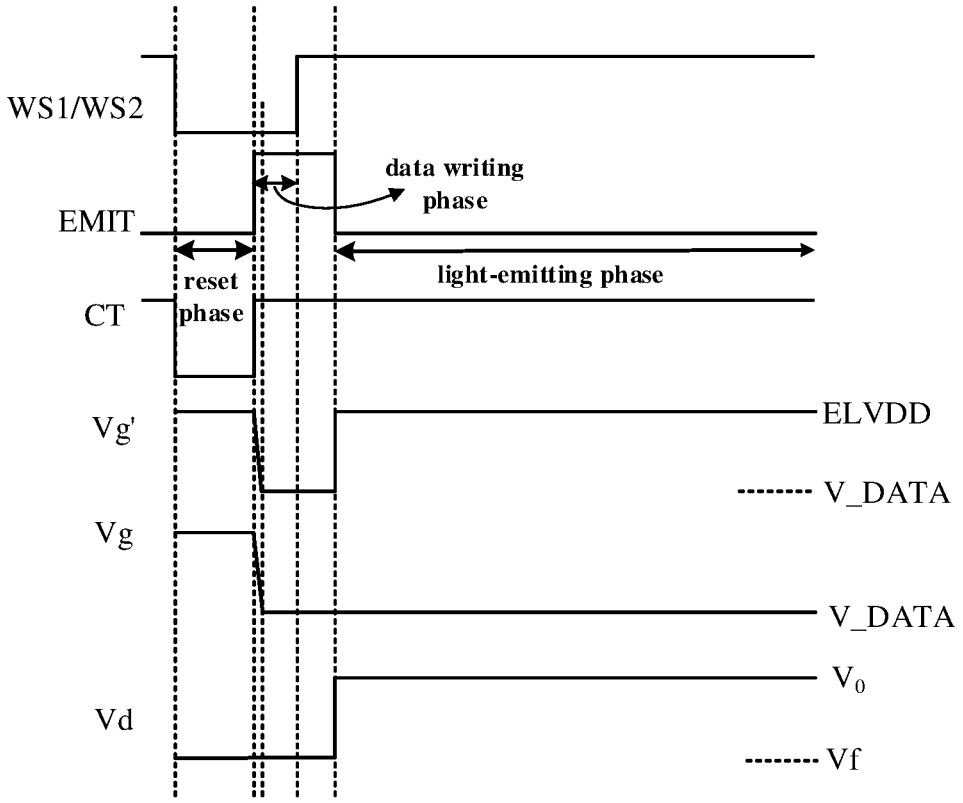
FIG. 4 is a sequence diagram of an operation of a pixel circuit according to an embodiment of the present disclosure.

The operation phases of the pixel circuit may include three main phases. Please refer to FIG. 3 and FIG. 4. FIG. 4 is a sequence diagram of operation of a pixel circuit according to an embodiment of the present disclosure.

During a reset phase, the first gating control signal WS1 is at a low level, the second gating control signal WS2 is at a low level, the light-emitting control signal EMIT is at a low level, the reset control signal CT is at a low level, the voltage buffer 301 is turned off (in a power-off state), and the voltage at the output terminal of the voltage buffer 301 is at a high level.

Further, in order to achieve that the voltage at the output terminal of the voltage buffer 301 is at a high level in the reset phase, the output terminal of the voltage buffer 301 may be connected to the power supply ELVDD through a switch device or connected to another power supply terminal (not shown).

During the reset phase, the second transistor P2, the third transistor P3, the fourth transistor P4, and the fifth transistor P5 are turned on. Since the second transistor P2 is turned on, the voltage Vg at the gate electrode of the first transistor P1 is equal to the voltage Vg' at the gate voltage terminal g', which is equal to the voltage at the output terminal of the voltage buffer 301. Since the voltage at the output terminal of the voltage buffer 301 is set to be at a high level, the voltage Vg' at the gate voltage terminal g' and the voltage Vg at the gate electrode of the first transistor P1 are also at a high level, that is, the first transistor P1 is turned off. Since the third transistor P3 and the fifth transistor P5 are turned on, the voltage Vd' at the drain voltage terminal d' is equal to the voltage Vd at the drain electrode of the first transistor P1, which is equal to the reset voltage Vf. Since the fourth transistor P4 is turned on, a voltage $V_0$ at the anode of the light-emitting device is also equal to the reset voltage Vf. The reset voltage Vf is set to be smaller than the turn-on voltage of the light-emitting device OLED, and then the light-emitting device OLED does not emit light during the reset phase.

The reset operation can eliminate an influence of a pixel display state in a previous frame of pixel on a pixel display state in a next frame of pixel.

During the data writing phase, the first gating control signal WS1 is at a low level, the second gating control signal WS2 is at a low level, the light-emitting control signal EMIT is at a high level, the reset control signal CT is at a high level, the voltage buffer 301 is turned on (in a power-on state), and the output terminal of the voltage buffer 301 does not receive a high level signal.

During the data writing phase, the second transistor P2 and the third transistor P3 are turned on, the fourth transistor P4 is turned off, and the fifth transistor P5 is turned off. The voltage buffer 301 forms a negative feedback loop with the first transistor P1 and the data current I_DATA inputted by the data current module 4. Due to feedback adjustment of the negative feedback loop, when the negative feedback loop is in a stable operation state, a voltage at a positive electrode of the voltage buffer 301 is equal to a voltage at a negative electrode of the voltage buffer 301, which is equal to the first input voltage VINT1 received by the negative electrode, that is, the voltage buffer 301 is in a virtual short-circuit state after the negative feedback loop is in a stable operation state. Since the third transistor P3 is turned on, the voltage Vd' at the drain voltage terminal d' is equal to the voltage Vd at the drain electrode of the first transistor P1, which is equal to the voltage at the negative electrode of the voltage buffer 301. Since the source electrode of the first transistor P1 is directly connected to the power supply ELVDD, the voltage at the source electrode of the first transistor P1 and the voltage Vd at the drain electrode of the first transistor P1 both have constant values, and the voltage Vg at the gate electrode of the first transistor P1 can one-to-one correspond to the data current I_DATA. The data current I_DATA can pull down the Vg originally in a high voltage state to a low voltage state corresponding to the data current I_DATA. At this time, control of brightness of the light-emitting device OLED by the data current I_DATA is converted to control of brightness of the light-emitting device OLED by the voltage Vg at the gate electrode of the first transistor P1.

Further, the time required for the voltage Vg at the gate electrode of the first transistor P1 to be pulled down to the low voltage state corresponding to the data current I_DATA depends on a gain bandwidth product and a slew rate of the voltage buffer 301. The gain bandwidth product is a product of a gain and a bandwidth of the voltage buffer 301 and is a parameter for evaluating a performance of the voltage buffer 301. The larger the gain bandwidth product is, the faster the feedback loop to which the voltage buffer 301 belongs is adjusted to a steady state, that is, the shorter the time required for the voltage Vg at the gate electrode of the first transistor P1 to be pulled down to the low voltage state corresponding to the data current I_DATA is. The slew rate refers to a slew rate of the output voltage of the voltage buffer 301, which is a parameter for evaluating a speed of the voltage buffer 301. The larger the slew rate is, the faster the feedback loop to which the voltage buffer 301 belongs is adjusted to a steady state, that is, the shorter the time required for the voltage Vg at the gate electrode of the first transistor P1 to be pulled down to the low voltage state corresponding to the data current I_DATA.

In specific applications, the time required for the voltage Vg at the gate electrode of the first transistor P1 to be pulled down to the low voltage state corresponding to the data current I_DATA can be shortened by increasing the gain bandwidth product and the slew rate of the voltage buffer 301.

During the light-emitting phase, the first gating control signal WS1 is at a high level, the second gating control signal WS2 is at a high level, the light-emitting control signal EMIT is at a low level, the reset control signal CT is at a low level, and the voltage buffer 301 is in a power-off state.

During the light-emitting phase, the second transistor P2, the third transistor P3, the fifth transistor P5 are turned off, and the fourth transistor P4 is turned on. Since the second transistor P2 is turned off, the voltage Vg at the gate electrode of the first transistor P1 is maintained by the capacitance Cst. Since the fourth transistor P4 is turned on, the operation current corresponding to the voltage Vg at the gate electrode of the first transistor P1 flows to the light-emitting device OLED through the fourth transistor P4, so as to drive the light-emitting device OLED to emit light. Since the Vg at this time is in a voltage state corresponding to the data current I_DATA, the brightness of the light-emitting device is actually determined by the data current I_DATA.

The light-emitting device OLED will age after working for a certain period of time. For a same operation current, the brightness of the aged light-emitting device OLED will dim under a same condition, and a voltage $V_0$ at the anode will rise accordingly.

Figure 5:
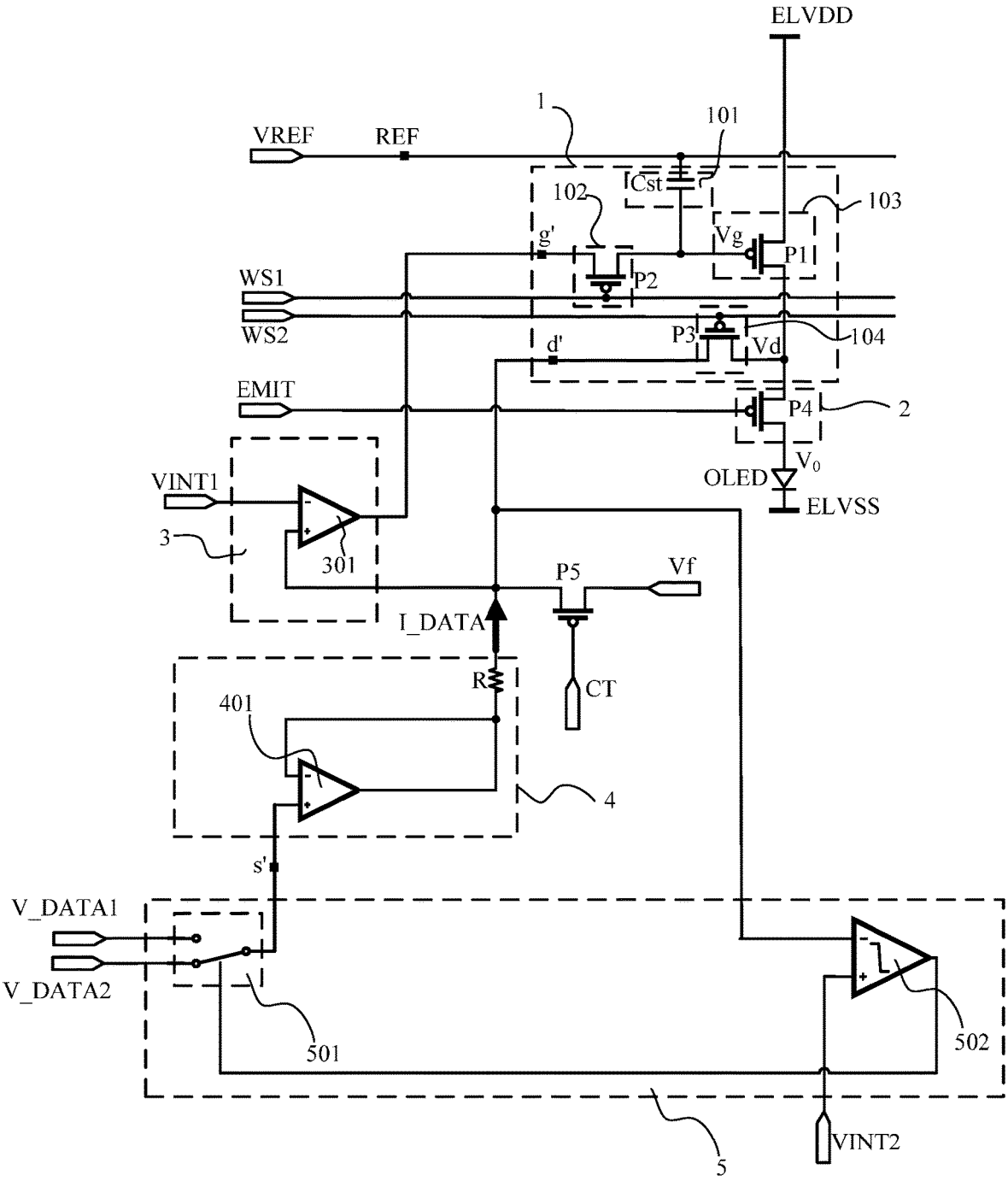
FIG. 5 is a schematic diagram of a structure of another pixel circuit according to an embodiment of the present disclosure.

FIG. 5 is a schematic diagram of a structure of another pixel circuit according to an embodiment of the present disclosure. The pixel circuit can compensate for the brightness of the light-emitting device OLED, and the brightness dimming can be alleviated in time after the light-emitting device OLED is aged.

With reference to FIG. 5, in a non-limiting embodiment, the pixel circuit can include a pixel unit, a driving control circuit, and a brightness adjustment module 5. For a structure and operation principle of the pixel unit and the driving control circuit, reference may be made to descriptions of the pixel circuit in FIG. 3 and FIG. 4, and details will not be further described herein.

The brightness adjustment module 5 is adapted to compare the voltage Vd' at the drain voltage terminal d' with a preset voltage VINT2 and output a compensation control signal that controls the data voltage terminal s' to receive different data voltages.

Further, the brightness adjustment module 5 may include a comparator 502 and a gating switch 501. The comparator 502 includes a first input terminal for receiving the preset voltage VINT2, a second input terminal connected to the drain voltage terminal d', and an output terminal for outputting the compensation control signal. The gate switch 501 includes a first input terminal for receiving the first data voltage V_DATA1, a second input terminal for receiving the second data voltage V_DATA2, an output terminal connected to the data voltage terminal s', and a control terminal for receiving the compensation control signal. The comparator 502 is preferably a hysteresis comparator.

Further, the first data voltage V_DATA1 may be different from the second data voltage V_DATA2. For example, the first data voltage V_DATA1 may be smaller than the second data voltage V_DATA2.

Further, the first data voltage V_DATA1 and the second data voltage V_DATA2 may be voltages with constant voltage values, or voltages with adjustable voltage values, so as to adapt to various degrees of aging of the light-emitting device OLED. A person skilled in the art can adaptively set the voltage values of the first data voltage V_DATA1 and the second data voltage V_DATA2 according to specific needs and applications, which is not limited herein by the embodiments of the present disclosure.

Further, the first input terminal of the comparator 502 may be a positive input terminal of the comparator 502, and the second input terminal of the comparator 502 may be a negative input terminal of the comparator 502.

In a specific implementation, the voltage $V_0$ at the anode when the light-emitting device OLED normally emits light is collected, and the preset voltage VINT2 at the positive input terminal of the comparator 502 is adjusted to be equal to the voltage $V_0$ at the anode of the light-emitting device OLED. After the light-emitting device OLED has been used for a period of time, if the light-emitting device OLED has been aged, the voltage $V_0$ at the anode of the light-emitting device OLED is increased. The voltage at the anode of the aged light-emitting device OLED is fed back to the negative electrode of the comparator 502 through the drain voltage terminal d', and the output terminal of the comparator 502 outputs the compensation control signal. Specifically, the compensation control signal may be a level jump signal.

Next, the control terminal of the gating switch 501 receives the compensation control signal, and the gating switch 501 is triggered to connect a smaller first data voltage V_DATA1 to the data voltage terminal s'. The smaller first data voltage V_DATA1 is converted into a smaller data current I_DATA, and the smaller data current I_DATA passing through the feedback loop further lowers the voltage Vg' at the gate voltage terminal g' and the voltage Vg at the gate electrode of the first transistor P1. Since the source electrode of the first transistor P1 is connected to the power supply ELVDD, that is, the voltage at the source electrode of the first transistor P1 has a constant value, if the voltage Vg at the gate electrode of the first transistor P1 is lowered, a voltage difference between the voltage at the source electrode of the first transistor P1 and the voltage Vg at the gate electrode of the first transistor P1 will be increased. As a result, an operation current flowing through the light-emitting device OLED is increased, thereby increasing the brightness of the light-emitting device OLED so as to compensate for the brightness dimming of the light-emitting device OLED due to self-aging.

Figure 6:
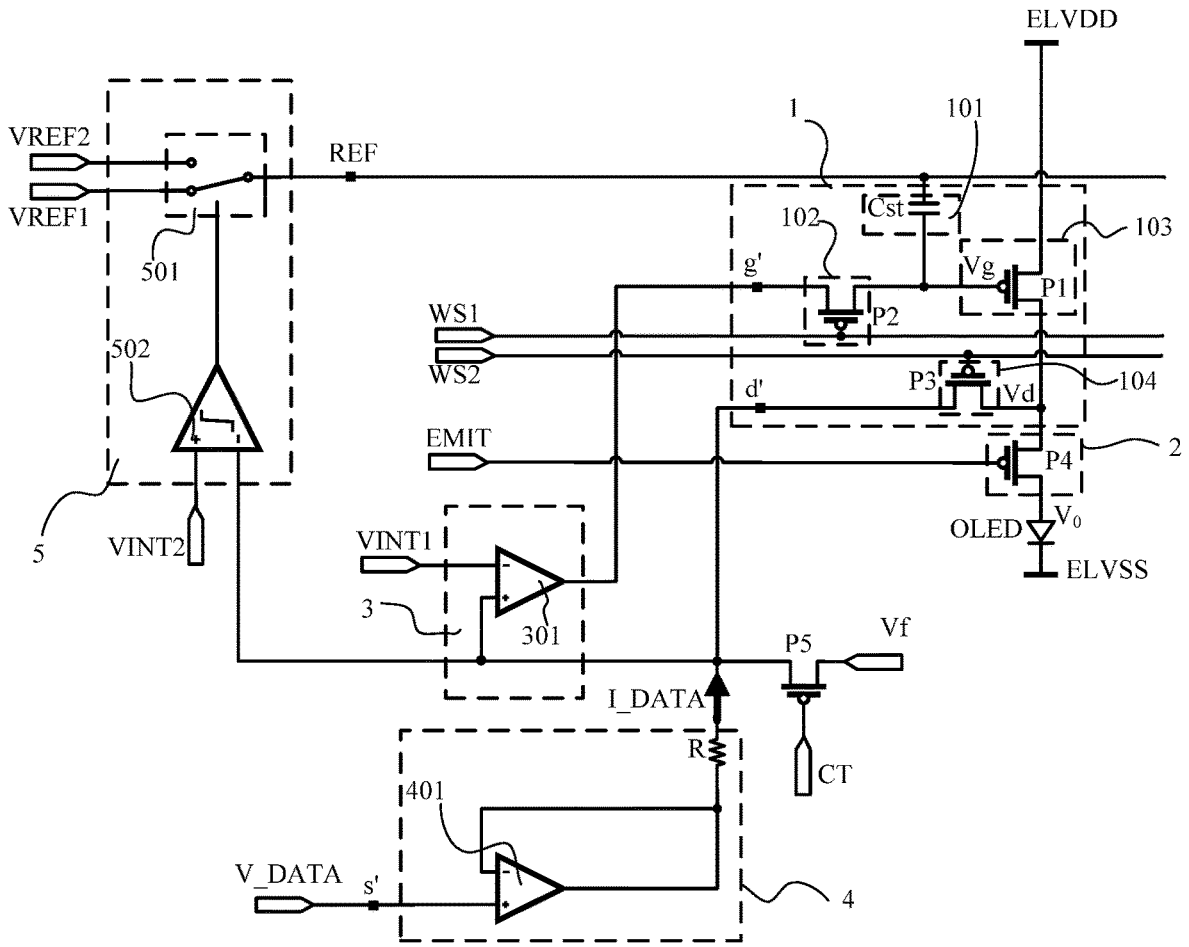
FIG. 6 is a schematic diagram of a structure of still another pixel circuit according to an embodiment of the present disclosure.

FIG. 6 is a schematic diagram of a structure of still another pixel circuit according to an embodiment of the present disclosure. The pixel circuit can compensate for the brightness of the light-emitting device OLED, and the problem of brightness dimming can be alleviated in time after the light-emitting device OLED is aged.

With reference to FIG. 6, in another non-limiting embodiment, the pixel circuit may include a pixel unit, a driving control circuit, and a brightness adjustment module 5. For the structure and operation principle of the pixel unit and the driving control circuit, reference may be made to the description of the pixel circuit in FIG. 3 and FIG. 4, and details will not be further described herein.

The brightness adjustment module 5 is adapted to compare the voltage Vd' at the drain voltage terminal d' with the preset voltage VINT2 and output a compensation control signal that controls the reference voltage terminal REF to receive different reference voltages.

Further, the brightness adjustment module 5 may include a comparator 502 and a gating switch 501. The comparator 502 includes an input terminal for receiving the preset voltage VINT2, a second input terminal connected to the drain voltage terminal d', and an output terminal for outputting the compensation control signal. The gating switch 501 includes a first input terminal for receiving the first reference voltage VREF1, a second input terminal for receiving the second reference voltage VREF2, an output terminal connected to the reference voltage terminal REF, and a control terminal for receiving the compensation control signal. The comparator 502 is preferably a hysteresis comparator.

Further, the first reference voltage VREF1 may be different from the second reference voltage VREF2. For example, the first reference voltage VREF1 may be smaller than the second reference voltage VREF2.

Further, the first reference voltage VREF1 and the second reference voltage VREF2 may be voltages with constant voltage values or voltages with adjustable voltage values, so as to adapt to various degrees of aging of the light-emitting device OLED. A person skilled in the art can adaptively set the voltage values of the first data voltage V_DATA1 and the second data voltage V_DATA2 according to specific needs and applications, which is not limited herein by the embodiments of the present disclosure.

Further, the first input terminal of the comparator 502 may be a positive input terminal of the comparator 502, and the second input terminal of the comparator 502 may be a negative input terminal of the comparator 502.

In a specific implementation, the voltage $V_0$ at the anode when the light-emitting device OLED normally emits light is collected, and the preset voltage VINT2 at the positive electrode of the comparator 502 is adjusted to be equal to the voltage $V_0$ at the anode. After the light-emitting device OLED has been used for a period of time, if the light-emitting device OLED has been aged, the voltage $V_0$ at the anode of the light-emitting device OLED is increased. The voltage at the anode of the aged light-emitting device OLED is fed back to the negative electrode of the comparator 502 through the drain voltage terminal d', and the output terminal of the comparator 502 outputs the compensation control signal. Specifically, the compensation control signal may be a level jump signal.

Next, the control terminal of the gating switch 501 receives the compensation control signal, and the gating switch 501 is triggered to connect a smaller first reference voltage VREF1 to the reference voltage terminal REF. At this time, the voltage of the second electrode plate of the capacitor Cst is lowered, and the voltage of the first electrode plate of the capacitor Cst is also lowered due to charge conservation. Since the gate electrode of the first transistor P1 is connected to the first electrode plate of the capacitor Cst, the voltage Vg at the gate electrode of the first transistor P1 is correspondingly lowered. Since the source electrode of the first transistor P1 is connected to the power supply ELVDD, that is, the voltage at the source electrode of the first transistor P1 has a constant value, if the voltage Vg at the gate electrode of the first transistor is lowered, a voltage difference between the voltage at the source electrode of the first transistor P1 and the voltage Vg at the gate electrode of the first transistor P1 will be increased. As a result, an operation current flowing through the light-emitting device OLED is increased, thereby increasing the brightness of the light-emitting device OLED so as to compensate for the brightness dimming of the light-emitting device OLED due to self-aging.

It should be understood by those skilled in the art that compensation for the brightness dimming of the light-emitting device OLED due to self-aging is not limited to the above-described manner of changing the data voltage or changing the reference voltage, and the brightness compensation can be achieved as long as the operation current of the light-emitting device OLED is increased, which will not be limited herein by the embodiments of the present disclosure.

Further, an embodiment of the present disclosure further discloses a display device including the pixel circuit described above. Further, the pixel circuit may be any pixel circuit illustrated in FIG. 3, FIG. 5, and FIG. 6, or any pixel circuit mentioned in the related description of FIG. 3, FIG. 5, and FIG. 6.

Specifically, the display device may be a liquid crystal display (LCD), a plasma display (PDP), a field emission display (FED), an electroluminescent display (ECD), an electrochromic display (ECD), a laser display (LPD), etc.

For a detailed description of the display process and the brightness compensation of the display device using the above-mentioned pixel circuit, reference may be made to the related description of the pixel circuit in the embodiments shown in FIG. 3 to FIG. 6, and details will not be further described herein.

It should be noted that the voltage values of "high level" and "low level" in the present disclosure are not specifically limited, as long as the voltage value of the high level is higher than the voltage value of the low level. For example, the voltage value of the high level may be identified as a logic 1 and the voltage value of the low level may be identified as a logic 0.

Although the present disclosure has been disclosed above, the present disclosure is not limited thereto. Any changes and modifications may be made by those skilled in the art without departing from the spirit and scope of the present disclosure, and the scope of the present disclosure shall be defined by the appended claims.

What is claimed is:

1. A pixel circuit, comprising:

a pixel unit comprising:

an operation current generating module comprising a gate voltage terminal and a drain voltage terminal and adapted to generate an operation current based on a voltage at the gate voltage terminal; and a light-emitting control module connected in series with the operation current generating module and adapted to control whether or not to provide the operation current to a light-emitting device based on a light-emitting control signal; and a driving control circuit comprising:

a feedback module for receiving a first input voltage and a data current and adapted to provide a feedback loop between the gate voltage terminal and the drain voltage terminal; and a data current module adapted to provide the data current, wherein the data current module is connected to a data voltage terminal, and the data current module is adapted to generate the data current based on a voltage at the data voltage terminal; and the data current module comprises an operational amplifier and a resistor, and the data current module is adapted to generate the data current based on a voltage at the data voltage terminal, the operational amplifier comprises a first input terminal connected to the data voltage terminal, a second input terminal, and an output terminal connected to the second input terminal of the operational amplifier, and the resistor comprises a firs terminal connected to the output terminal of the operational amplifier, and a second terminal connected to the drain voltage terminal.

2. The pixel circuit according to claim 1, further comprising a brightness adjustment module, wherein the brightness adjustment module is adapted to compare a voltage at the drain voltage terminal with a preset voltage and output a compensation control signal, and the compensation control signal controls the data voltage terminal to receive different data voltages.

3. The pixel circuit according to claim 2, wherein the brightness adjustment module comprises:

a comparator comprising a first input terminal for receiving the preset voltage, a second input terminal connected to the drain voltage terminal, and an output terminal for outputting the compensation control signal; and a gating switch comprising a first input terminal for receiving a first data voltage, a second input terminal for receiving a second data voltage, an output terminal connected to the data voltage terminal, and a control terminal for receiving the compensation control signal.

4. The pixel circuit according to claim 1, wherein the light-emitting control module comprises a fourth transistor, and the fourth transistor comprises a gate electrode for receiving the light-emitting control signal, a drain electrode connected to an output terminal of the operation current generating module, and a source electrode connected to the light-emitting device.

5. The pixel circuit according to claim 1, further comprising a fifth transistor, wherein the fifth transistor comprises a gate electrode for receiving a reset control signal, a source electrode for receiving a reset voltage, and a drain electrode connected to the drain voltage terminal.

6. A display device, comprising the pixel circuit according to claim 1.

7. A pixel circuit, comprising:

a pixel unit comprising:

an operation current generating module comprising a gate voltage terminal and a drain voltage terminal and adapted to generate an operation current based on a voltage at the gate voltage terminal; and a light-emitting control module connected in series with the operation current generating module and adapted to control whether or not to provide the operation current to a light-emitting device based on a light-emitting control signal; and a driving control circuit comprising:

a feedback module for receiving a first input voltage and a data current and adapted to provide a feedback loop between the gate voltage terminal and the drain voltage terminal; and a data current module adapted to provide the data current, wherein the operation current generating module comprises:

a driving module comprising a control terminal connected to the gate voltage terminal through a first gating module and adapted to generate the operation current based on a voltage at the control terminal of the driving module, wherein the first gating module is turned on or turned off under control of a first gating control signal;

a second gating module, through which an output terminal of the driving module is connected to the drain voltage terminal, wherein the second gating module is turned on or turned off under control of a second gating control signal; and a voltage maintaining module configured to maintain the voltage at the control terminal of the driving module when the first gating module is turned off.

8. The pixel circuit according to claim 7, wherein the driving module comprises a first transistor, and the first transistor comprises a source electrode connected to a power supply, a gate electrode being the control terminal of the driving module, and a drain electrode being the output terminal of the driving module.

9. The pixel circuit according to claim 7, wherein the first gating module comprises a second transistor, and the second transistor comprises a gate electrode for receiving the first gating control signal, a source electrode connected to the control terminal of the driving module, and a drain electrode connected to the gate voltage terminal.

10. The pixel circuit according to claim 7, wherein the second gating module comprises a third transistor, and the third transistor comprises a gate electrode for receiving the second gating control signal, a drain electrode connected to the drain voltage terminal, and a source electrode connected to the output terminal of the driving module.

11. The pixel circuit according to claim 7, wherein the voltage maintaining module comprises a capacitor, and the capacitor comprises a first electrode plate connected to the control terminal of the driving module, and a second electrode plate connected to a reference voltage terminal.

12. The pixel circuit according to claim 11, further comprising a brightness adjustment module, wherein the brightness adjustment module is adapted to compare a voltage at the drain voltage terminal with a preset voltage and output a compensation control signal, and the compensation control signal controls the reference voltage terminal to receive different reference voltages.

13. The pixel circuit according to claim 12, wherein the brightness adjustment module comprises:

a comparator comprising a first input terminal for receiving the preset voltage, a second input terminal connected to the drain voltage terminal, and an output terminal for outputting the compensation control signal; and a gating switch comprising a first input terminal for receiving a first reference voltage, a second input terminal for receiving a second reference voltage, an output terminal connected to the reference voltage terminal, and a control terminal for receiving the compensation control signal.

14. A pixel circuit, comprising:

a pixel unit comprising:

an operation current generating module comprising a gate voltage terminal and a drain voltage terminal and adapted to generate an operation current based on a voltage at the gate voltage terminal; and a light-emitting control module connected in series with the operation current generating module and adapted to control whether or not to provide the operation current to a light-emitting device based on a light-emitting control signal; and a driving control circuit comprising:

a feedback module for receiving a first input voltage and a data current and adapted to provide a feedback loop between the gate voltage terminal and the drain voltage terminal; and a data current module adapted to provide the data current, wherein the feedback module comprises a voltage buffer, and the voltage buffer comprises a first input terminal connected to the drain voltage terminal and to an output terminal of the data current module, a second input terminal for receiving the first input voltage, and an output terminal connected to the gate voltage terminal.

* * * * *